United States Patent [19]

Sano et al.

[11] Patent Number: 4,689,644

[45] Date of Patent: Aug. 25, 1987

[54] PRESSURE-SENSITIVE RECORDING SHEETS

[75] Inventors: Shojiro Sano; Keiso Saeki, both of Shizuoka, Japan

[73] Assignee: Fuji Photo Film Co., Ltd., Kanagawa, Japan

[21] Appl. No.: 833,704

[22] Filed: Feb. 27, 1986

[30] Foreign Application Priority Data

Feb. 27, 1985 [JP] Japan ..... 60-38529

[51] Int. Cl.[4] ..... B41M 5/16; B41M 5/22

[52] U.S. Cl. ..... 503/209; 503/212; 503/216; 503/225; 503/226; 427/150

[58] Field of Search ..... 346/212, 208, 209, 216, 346/225, 226, 210, 211; 427/150–152

[56] References Cited

U.S. PATENT DOCUMENTS 4,489,336 12/1984 Aoyagi et al. ..... 346/209

*Primary Examiner*—Bruce H. Hess

*Attorney, Agent, or Firm*—Sughrue, Mion, Zinn, Macpeak and Seas

[57] ABSTRACT

A pressure-sensitive recording sheet capable of providing colored images by a reaction of a substantially colorless electron donating dye precursor and an electron accepting developer is described, wherein a layer comprising the electron accepting developer of the pressure-sensitive recording sheet contains (1) a metal salt of an aromatic carboxyl acid, and (2) at least one of a 2-mercaptobenzothiazole and a 2-mercaptobenzimidazole.

15 Claims, No Drawings

PRESSURE-SENSITIVE RECORDING SHEETS

FIELD OF THE INVENTION

This invention relates to a pressure-sensitive recording sheet. More particularly, the invention relates to a pressure-sensitive recording sheet providing colored images by the reaction of a substantially colorless electron donating dye precursor (hereinafter, referred to as a color former) and an electron accepting developer (hereinafter, referred to as a developer).

BACKGROUND OF THE INVENTION

Pressure-sensitive recording materials utilizing a coloring reaction of a color former and a developer such as clay materials (e.g., acid clay, active clay, attapulgite, zeolite, bentonite, kaolin, etc.), metal salts of aromatic carboxylic acids, phenol-formaldehyde resins, etc., are well known as described, for example, in U.S. Pat. Nos. 2,505,470, 2,505,489, 2,550,471, 2,548,366, 2,712,507, 2,730,456, 2,730,457, and 3,418,250, Japanese Patent Application (OPI) Nos. 28411/74 and 44009/75, (the term "OPI" as used herein refers to a "published unexamined Japanese patent application"), etc.

In these developers, metal salts of aromatic carboxylic acids are excellent in light resistance, moisture resistance, solvent resistance, etc., of the colored materials formed, and are widely used at present.

However, even in the case of using metal salts of aromatic carboxylic acids as a developer, the light resistance and plasticizer resistance of colored materials formed are not yet fully satisfactory. The plasticizer resistance used herein refers to a property capable of preventing the disappearance of the colored images after placing a sheet containing the plasticizer.

SUMMARY OF THE INVENTION

The object of this invention is to provide a pressure-sensitive recording sheet capable of providing colored materials having greatly improved fastness to light and plasticizers.

As a result of extensive investigations, the inventors have discovered that the above-described object of this invention can be attained by a pressure-sensitive recording sheet capable of providing colored images by a reaction of a substantially colorless electron donating dye precursor and an electron accepting developer, wherein a layer comprising an electron accepting developer contains (1) a metal salt of an aromatic carboxylic acid, and (2) at least one of a 2-mercaptobenzothiazole and a 2-mercaptobenzimidazole.

DESCRIPTION OF THE PREFERRED EMBODIMENT

The invention is described below in detail.

Metal salts of aromatic carboxylic acids described, for example, in U.S. Pat. Nos. 3,864,146 and 3,983,292, Japanese Patent Application No. 25158/78, etc., can be used as the metal salt of aromatic carboxylic acid in this invention.

As the aromatic carboxylic acid in the above-described metal salts of aromatic carboxylic acids, those having a hydroxy group at the ortho-position or para-position to the carboxy group are useful, and of such carboxylic acids, salicylic acid derivatives are preferred. Furthermore, salicylic acid derivative each having a substituent such as an alkyl group, an aryl group, an aralkyl group, etc., at least one of the ortho-position and the para-position to the hydroxy group thereof, and the total sum of the carbon atoms of the substituent being 8 or more are particularly preferred.

The preferred aromatic carboxylic acid is represented by the following formula (I):

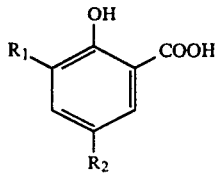

(I)

wherein $R_1$ and $R_2$, which may be the same or different, each represents an alkyl group having 3 to 10 carbon atoms, an aryl group having 6 to 12 carbon atoms or an aralkyl group having 7 to 15 carbon atoms, preferably a t-butyl group, a t-amyl group, a t-hexyl group, a α,-αdimethylbenzyl group or a α-methylbenzyl group.

Examples of the particularly preferred aromatic carboxylic acid are 3,5-di-t-butylsalicylic acid, 3,5-di-t-amylsalicylic acid, 3,5-bis(α,α-dimethylbenzyl(salicylic acid, 3,5-bis(α-methylbenzyl)salicylic acid, 3-(α-methylbenzyl)-5-(α,α-dimethylbenzyl)salicylic acid, 3,5-di-t-octylsalicylic acid, 3-cyclohexyl-5-(α,α-dimethyl-benzyl)salicylic acid, etc.

Examples of metal for forming the metal salts with the above-described aromatic carboxylic acids, include magnesium, aluminum, calcium, scandium titanium, vanadium, chromium, manganese, iron, cobalt, nickel, copper, zinc, potassium, germanium, strontium, ytterium, zirconium, molybdenum, cadmium, indium, tin, antimony, barium, etc. Of these metals, zinc, aluminum, and calcium are preferred, and zinc is particularly preferred.

The preferred compounds of a 2-mercaptobenzothiazole and a 2-mercaptobenzimidazole are represented by the following formulae (II) and (III) or a metal salt thereof:

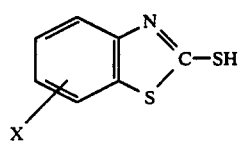

(II)

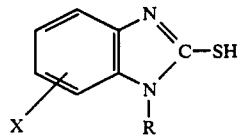

(III)

wherein X represents a hydrogen atom, a halogen atom or a lower alkyl group (preferably 1 to 5 carbon atoms), and R represents a hydrogen atom or a lower alkyl group (preferably 1 to 5 carbon atoms).

Preferred examples of the 2-mercaptobenzothiazoles for use in this invention are as follows:

(i) 2-Mercaptobenzothiazole,
(ii) 5-Chloro-2-mercaptobenzothiazole,
(iii) Sodium salt of 2-mercaptobenzothiazole,
(iv) Cobalt salt of 2-mercaptobenzothiazole,
(v) Zinc salt of 2-mercaptobenzothiaozole.

In these compounds, the zinc salt of 2-mercaptobenzothiazole is more preferred.

Preferred examples of the 2-mercaptobenzothiazoles are as follows:

(i) 2-Mercaptobenzimidazole.

(ii) Methyl-2-mercaptobenzimidazole.

(iii) Zinc salt of 2-mercaptobenzimidazole.

(iv) Zinc salt of methyl-2-mercaptobenzimidazole.

In these compounds, 2-mercaptobenzimidazole and the zinc salt of 2-mercaptobenzimidazole are more preferred.

A preferred amount of the 2-mercaptobenzothiazole of the 2-mercaptobenzimidazole is from 5 to 100% by weight based on the amount of the metal salt of aromatic carboxylic acid.

The 2-mercaptobenzothiazole or the 2-mercaptobenzimidazole is used as an aqueous dispersion formed by dispersing it in water or an aqueous system by means of a Kedy mill, a ball mill, an attriter, a sand mill, etc.

The 2-mercaptobenzothiazole or the 2-mercaptobenzimidazole may be dispersed as a mixture with the metal salt of aromatic carboxylic acid.

The metal salt of aromatic carboxylic acid is used as an aqueous dispersion or an emulsion.

The dispersion of the metal salt of aromatic carboxylic acid is prepared by mechanically dispersing it in water or an aqueous system by means of a ball mill, an attriter, a sand mill, etc.

Also, the emulsion of the metal salt of aromatic carboxylic acid is prepared by dissolving the metal salt of aromatic carboxylic acid in an organic solvent and then emulsifying the solution in water. The organic solvent to be used is a solvent capable of dissolving the metal salt of aromatic carboxylic acid in an amount of about 10% by weight or more. Examples of the solvent include aliphatic esters, aromatic esters, biphenyl derivatives, naphthalene derivatives, diphenylalkanes, etc.

A mixture of the dispersion of the metal salt of aromatic carboxylic acid and the emulsion of the metal salt of aromatic carboxylic acid may be used.

At the preparation of the coating composition for the developer layer of the pressure-sensitive recording material of this invention, use of an inorganic pigment such as titanium oxide, zinc oxide, silicon oxide, calcium oxide, calcium carbonate, aluminum hydroxide, kaolin, active clay, talc, barium sulfate, etc., gives desired effects such as the improvement of coating aptitude and covering power, improvement of developing ability, etc. When the inorganic pigment is dispersed by means of a media dispersing machine such as a sand mill, a ball mill, an attriter, etc., desired effects such as further improvements of developing ability, the quality of the coated surface, etc., can be obtained. The amount of the inorganic pigment is preferably from 1 to 100 parts by weight, and more preferably from 2 to 50 parts by weight per one part by weight of the metal salt of aromatic carboxylic acid.

The coating composition thus prepared is mixed with a binder and then coated on a support.

Examples of the binder for the developer layer in this invention include latexes such as a styrene-butadiene copolymer latex, etc., and synthetic or natural polymers such as polyvinyl alcohol, a maleic anhydride-styrene copolymer, starch, casein, gum arabic, gelatin, carboxymethyl cellulose, methyl cellulose, etc.

The final amount (coverage) of the metal salt of aromatic carboxylic acid coated on a support is generally from 0.1 g/m$^2$ to 3.0 g/m$^2$, preferably from 0.2 g/m$^2$ to 1.0 g/m$^2$.

There is no particular restriction on the color former which is used for causing a reaction with the metal salt of aromatic carboxylic acid for the recording sheet of this invention. The color former is preferably used in an amount of 0.05 to 0.5 g/m$^2$. Specific examples of the color former for use in this invention are a triarylmethane series compound, a diphenylmethane series compound, a xanthene series compound, a thiazine series compound, a spiropyran series compound, etc., or mixtures thereof. Specific examples of triarylmethane compounds include 3,3-bis-(p-dimethylaminophenyl)-6-dimethylaminophthalide (namely, Crystal Violet lactone), 3,3-bis-(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis-(1,2-dimethylindol-3-yl)-6-dimethylaminophthalide, 3,3-bis-(9-ethylcarbazol-3-yl)-5-dimethylaminophthalide, 3,3-bis-(2-phenylindol-3-yl)-5-dimethylaminophthalide and 3-p-dimethylaminophenyl-3-(1-methylpyrrol-2-yl)-6-dimethylaminophthalide. Specific examples of diphenylmethane compounds include 4,4'-bis-dimethylaminobenzhydrin benzyl ether, N-halophenyl leuco Auramine and N-2,4,5-trichlorophenyl leuco Auramine. Specific examples of xanthene compounds include Rhodamine B anilino lactam, Rhodamine (p-nitroanilino)lactam, Rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)fluoran, 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran and 7-diethylamino-3-(diethylamino)fluoran. Specific examples of thiazine compounds include benzoyl leuco Methylene Blue and p-nitrobenzyl leuco Methylene Blue. Specific examples of spiropyran compounds include 3-methyl-spiro-dinaphthopyran, 3-ethyl-spiro-dinaphthopyran, 3,3'-dichloro-spiro-dinaphthopyran, 3-benzyl spiro-dinaphthopyran, 3-methyl-naphtho-(3-methoxybenzo)spiropyran and 3-propyl-spiro-dibenzopyran. These compounds may be used alone or as a mixture.

The color former for use in this invention is coated on a support as a coating composition in which the color former is dissolved in a solvent and microcapsulated, or as a coating composition in the form of a dispersion in a binder situation.

As the solvent, natural or synthetic oils can be used solely or as a mixture thereof. Examples of the solvent are cotton seed oil, kerosene, paraffin, naphthene oil, alkylated biphenyl, alkylated tarphenyl, chlorinated paraffin, alkylated naphthalene, diphenylalkane, etc.

The color former-containing microcapsules can be produced by an interfacial polymerization method, an internal polymerization method, a phase separation method, an external polymerization method, a coacervation method, etc., as described, for example, in U.S. Pat. Nos. 2,800,457, 2,800,458, 3,287,154, 3,418,250 and 3,726,804.

In the case of preparing a coating composition containing the color former-containing microcapsules, a water-soluble binder or a latex series binder is generally used. Furthermore, a capsule protective material such as a cellulose powder, starch particles, talc, etc., are added thereto to provide a coating composition of color former-containing microcapsules.

The developer sheet for pressure-sensitive recording in this invention was subjected to property tests using a color former-containing microcapsule sheet as described below.

Preparation of Color Former-Containing Microcapsule Sheet

In 95 parts (by. weight) of hot water of about 80° C. was dissolved 5 parts of a partial sodium salt of polyvinylbenzenesulfonic acid (VERSA, TL 500, average molecular weight 500,000, trademark of a product made by National Starch Co.) with stirring over a period of about 30 minutes and then the solution thus formed was cooled. The pH of the aqueous solution was 2 to 3 and the pH thereof was adjusted to 4.0 by the addition of an aqueous solution of 20 wt % sodium hydroxide. Then, 100 parts of diisopropylnaphthalene having dissolved therein 2.5% Crystal Violet lactone and 1.0% benzoyl leucomethylene blue was dispersed by emulsification in 100 parts of 5% aqueous solution of the above-described partial sodium salt of polyvinylbenzenesulfonic acid to provide an emulsion having average particle sizes (average diameter) of 4.5 μm.

Apart from this, a mixture of 6 parts of melamine, 11 parts of an aqueous solution of 37% by weight formaldehyde, and 30 parts of water was stirred at 60° C. for 30 minutes to provide a transparent aqueous solution of a mixture of melamine, formaldehyde, and an initial condensation product of melamine and formaldehyde. The pH of the aqueous solution of the mixture was from 6 to 8. Hereinafter, the aqueous solution of a mixture of melamine, formaldehyde, and the initial condensation product of melamine and formaldehyde is referred to as the initial condensate solution.

The initial condensate solution obtained as described above was mixed with the above-described emulsion, the pH of the mixture was adjusted to 6.0 with an aqueous solution of 3.6% by weight hydrochloric acid with stirring, and after raising the temperature thereof to 65° C., the mixture was further stirred for 360 minutes. The microcapsule dispersion thus obtained was cooled to room temperature and the pH thereof was adjusted to 9.0 with an aqueous solution of 20% by weight sodium hydroxide.

Then, to the microcapsule dispersion were added 200 parts of an aqueous solution of 10% by weight polyvinyl alcohol and 50 parts of starch particles, and the concentration of the solid components was adjusted to 20% by weight by the addition of water to provide a color former-containing microcapsule coating composition.

The coating composition was coated on a base paper of 50 g/m$^2$ basis weight at a solid component coverage of 5 g/m$^2$ by an air knife coater, and then dried to provide a color former-containing microcapsule sheet.

The invention is further explained more practically by the following examples, but it is to be understood that the invention is not limited to these examples. In addition, all parts, percents and ratios in these examples, unless other indicated, are by weight.

EXAMPLE I - 1

Preparation of Emulsion

In 20 parts of 1-isopropylphenyl-2-phenylethane was dissolved 10 parts of zinc 3,5-bis(α-methylbenzyl) salicylate at 90° C. The solution thus formed was added to 50 parts of an aqueous solution of 2% polyvinyl alcohol (PVA-205, trademark of a product made by Kuraray Co., Ltd.) and after adding thereto 0.1 part of an aqueous solution of 10% sodium sulfosuccinate as a surface active agent, the mixture was emulsified by means of a homogenizer so that the average particle size of the emulsion became about 3 μm, to thus provide Emulsion (A).

Preparation of Dispersion

Then, 5 parts of zinc 3,5-bis(α-methylbenzyl)-salicylate, 5 parts of a zinc salt of 2-mercaptobenzothiazole, 170 parts of calcium carbonate, 20 parts of zinc oxide, 1 part of sodium hexametaphosphate, and 200 parts of water were uniformly dispersed by a sand grinder so that the average particle size became 3 μm to provide Dispersion (A).

Preparation of Coating Composition

To a mixture of 40 parts of Emulsion (A) and 200 parts of Dispersion (A) were added 100 parts of an aqueous solution of 10% polyvinyl alcohol (PVA-110, trademark of a product made by Kuraray Co., Ltd.) and 10 parts (as solid component) of a carboxy-modified styrene-butadiene (SBR) latex (SN-304, trademark of a product made by Sumitomo Nogatax Co., Ltd.) and water was added to the mixture so that the solid component concentration became 20% to provide the coating composition.

Preparation of Developer Sheet

The coating composition prepared in the above step was coated on a base paper of 50 g/m$^2$ basis weight at a solid component coverage of 5.0 g/m$^2$ by an air knife coater, and dried to provide a developer sheet.

EXAMPLE I - 2

By following the same procedure as in Example I - 1, except that 5 parts of 2-mercaptobenzimidazole was used in place of 5 parts of the zinc salt of 2-mercaptobenzothiazole in the preparation of Dispersion (A), a developer sheet was prepared.

EXAMPLE I - 3

By following the same procedure as in Example I - 1, except that 5 parts of a zinc salt of 2-mercaptobenzimidazole was used in place of 5 parts of the zinc salt of 2-mercaptobenzothiazole in the preparation of Dispersion (A), a developer sheet was prepared.

COMPARISON EXAMPLE I

By following the same procedure as in Example I - 1, except that the zinc salt of 2-mercaptobenzothiazole was not used in the preparation of Dispersion (A), a developer sheet was prepared.

EXAMPLE II

Preparation of Dispersion

A mixture of 15 parts of zinc 3,5-di-t-butyl-salicylate, 5 parts of a zinc salt of 2-mercaptobenzothiazole, 170 parts of calcium carbonate, 20 parts of zinc oxide, 1 part of sodium hexametaphosphate, and 200 parts of water was uniformly dispersed by a sand grinder so that the average particle size thereof became 3 μm to provide Dispersion (B).

Preparation of Coating Composition

To 400 parts of Dispersion (B) were added 100 parts of an aqueous solution of 10% polyvinyl alcohol (PVA) (a saponification degree of 99%, a polymerization of 1,000) and 10 parts (as solid components) of a calboxy-modified styrene-butadiene (SBR) latex and water was added thereto so that the solid component concentration became 20% to provide a coating composition.

Preparation of Developer Sheet

The coating composition prepared in the above step was coated on a base paper of 50 g/m$^2$ basis weight at a solid component coverage of 5.0 g/m$^2$ by an air knife coater and dried to provide a developer sheet.

COMPARISON EXAMPLE II

By following the same procedure as in Example II, except that the zinc salt of 2-mercaptobenzothiazole was not used in the preparation of Dispersion (B), a developer sheet was prepared.

The properties of the developer sheets thus prepared were tested as follows.

(1) Developing Ability:

The color former-containing microcapsule sheet prepared as described above was placed on each of the developer sheets prepared in the above-described examples and comparison examples so that the coated layers of them were in face-to-face relationship, a load of 600 kg/cm$^2$ was applied thereto to cause coloring, and then the density of the colored material at 610 nm was measured by Hitachi Color Analyzer Type 307 10 minutes after initiation coloring. The density was used as the developing faculty.

(2) Light Resistance:

After irradiating the colored material of each of the samples in the aforesaid examples and comparison examples after 10 minutes of coloring and thus obtained in above (1) with a xenon Fade-O-Meter (Suga Tester, FAL-25AX-HC Type) for 4 hours, the density thereof at 610 nm was measured and the ratio of the density after irradiation by the Fade-O-Meter to the density before irradiation was defined as the light resistance.

(3) Plasticizer Resistance:

On the colored material of each of the samples, 10 minutes after initiation of coloring obtained in above (1), was placed a soft polyvinyl chloride sheet (0.5 mm in thickness, containing 15% by weight dibutyl phthalate and 7% by weight dioctyl phthalate as plasticizers) and after applying a load of 100 g/cm$^2$ for 72 hours at 50° C. and 20% in relative humidity and the density at 610 nm was measured. The ratio of the density after placing the polyvinyl chloride sheet to the density before placing the polyvinyl chloride sheet was defined as the plasticizer resistance.

The results thus obtained are shown in Table 1.

TABLE 1

| Sample | Property: Developing Faculty | Light Resistance | Plasticizer Resistance |
|---|---|---|---|
| Example I-1 | 1.03 | 0.70 | 0.77 |
| Example I-2 | 1.01 | 0.63 | 0.77 |
| Example I-3 | 1.02 | 0.68 | 0.80 |

TABLE 1-continued

| Sample | Property: Developing Faculty | Light Resistance | Plasticizer Resistance |
|---|---|---|---|
| Comparison Example I | 1.01 | 0.40 | 0.45 |
| Example II | 0.99 | 0.60 | 0.75 |
| Comparison Example II | 0.96 | 0.35 | 0.38 |

From the result shown above, it can be seen that the developer sheets in the examples of this invention are excellent in the fastness of the colored images to light and plasticizers as compared with the developer sheets in the comparison examples.

While the invention has been described in detail and with reference to specific embodiments thereof, it will be apparent to one skilled in the art that various changes and modifications can be made therein without departing from the spirit and scope thereof.

What is claimed is:

1. A pressure-sensitive recording sheet capable of providing colored images by a reaction of a substantially colorless electron donating dye precursor and an electron accepting developing, said sheet comprising a layer containing said electron donating dye precursor and a layer containing said electron accepting developer, wherein the electron accepting developer layer contains (1) a metal salt of an aromatic carboxylic acid, and (2) at least one of a 2-mercaptobenzothiazole and a 2-mercaptobenzimidazole.

2. A pressure-sensitive recording sheet as in claim 1, wherein the aromatic carboxylic acid of the metal salt of aromatic carboxylic acid is a salicylic acid derivative.

3. A pressure-sensitive recording sheet as in claim 2, wherein the salicylic acid has a substituent at at least one of the ortho-position and the para-position thereof with respect to the hydroxy group, and the total number of carbon atoms of all of the substituents is 8 or more.

4. A pressure-sensitive reocrding sheet as in claim 1, wherein the aromatic carboxylic acid used is represented by the following formula (I):

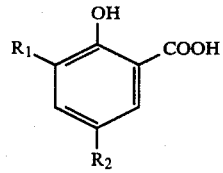

(I)

wherein $R^1$ and $R^2$, which may be same or different, each represents an alkyl group having 3 to 10 carbon atoms, an aryl group having 6 to 12 carbon atoms or an aralkyl group having 7 to 15 carbon atoms.

5. A pressure-sensitive recording sheet as in claim 4, wherein the carboxylic acid used is represented by the formula (I) and wherein $R^1$ and $R^2$, which may be the same or different, each represents a t-butyl group, a t-amyl group, a t-hexyl group, a α,α-dimethyl-benzyl group or a a α-methylbenzyl group.

6. A pressure-sensitive recording sheet as in claim 1, wherein the metal salt is a zinc salt.

7. A pressure-sensitive recording sheet as in claim 1, wherein the 2-mercaptobenzothiazole and 2-mercaptobenzimidazole are represented by the following formulae (II) and (III) or a metal salt thereof:

(II)

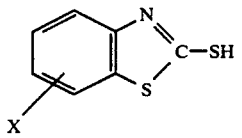

(III)

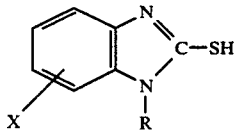

wherein X represents a hydrogen atom, a halogen atom or a lower alkyl group, and R represents a hydrogen atom or a lower alkyl group.

8. A pressure-sensitive recording sheet as in claim 7, wherein the 2-mercaptobenzothiazole is selected from the group consisting of 5-chloro-2-mercaptobenzothiazole, a sodium salt of 2-mercaptobenzothiazole, and a cobalt salt of 2-mercaptobenzothiazole.

9. A pressure-sensitive recording sheet as in claim 7, wherein the 2-mercaptobenzimidazole is selected from the group consisting of methyl-2-mercaptobenzimidazole and a zinc salt of methyl-2-mercaptobenzimidazole.

10. A pressure-sensitive recording sheet as in claim 1, wherein the 2-mercaptobenzothiazole is a zinc salt of a 2-mercaptobenzothiazole.

11. A pressure-sensitive recording sheet as in claim 1, wherein the 2-mercaptobenzimidazole is 2-mercaptobenzimidazole or a zinc salt of 2-mercaptobenzimidazole.

12. A pressure-sensitive recording sheet as in claim 1, wherein the electron donating dye precursor is present in the form of a layer of microcapsules thereof.

13. A pressure-sensitive recording sheet as in claim 1, wherein the metal salt of aromatic carboxylic acid is coated in an amount of from 0.1 $g/m^2$ to 3.0 $g/m^2$.

14. A pressure-sensitive recording sheet as in claim 1, wherein the 2-mercaptobenzothiazole or the 2-mercaptobenzimidazole is present in an amount from 5 to 100 percent by weight based on the amount of the metal salt of the aromatic carboxylic acid.

15. A pressure-sensitive recording sheet as in claim 1, wherein the 2-mercaptobenzothiazole and/or the 2-mercaptobenzimidazole are used as an aqueous dispersion formed by dispersing the compounds in water or an aqueous system.

* * * * *